US006651464B2

(12) United States Patent
Ueyama

(10) Patent No.: US 6,651,464 B2
(45) Date of Patent: Nov. 25, 2003

(54) SELECTOR ACTUATOR FOR KNITTING MEMBERS IN A KNITTING MACHINE

(75) Inventor: Hiroyuki Ueyama, Wakayama (JP)

(73) Assignee: Shima Seiki Manufacturing Ltd., Wakayama (JP)

( * ) Notice: Subject to any disclaimer, the term of this patent is extended or adjusted under 35 U.S.C. 154(b) by 0 days.

(21) Appl. No.: 10/343,922

(22) PCT Filed: Aug. 27, 2001

(86) PCT No.: PCT/JP01/07334

§ 371 (c)(1),
(2), (4) Date: Feb. 6, 2003

(87) PCT Pub. No.: WO02/18690

PCT Pub. Date: Mar. 7, 2002

(65) Prior Publication Data

US 2003/0172686 A1 Sep. 18, 2003

(30) Foreign Application Priority Data

Aug. 28, 2000 (JP) ..... 2000-256782

(51) Int. Cl.[7] ..... D04B 15/78
(52) U.S. Cl. ..... 66/219; 66/75.2
(58) Field of Search ..... 66/215, 218, 219, 66/220, 221, 75.2, 75.1

(56) References Cited

U.S. PATENT DOCUMENTS 3,605,448 A 9/1971 Ribler
4,715,198 A 12/1987 Ploppa et al.
5,694,792 A 12/1997 Nakamori et al.
5,802,878 A * 9/1998 Nakamori et al. ..... 66/64
5,819,559 A * 10/1998 Nakamori et al. ..... 66/232

FOREIGN PATENT DOCUMENTS

JP 08-502791 3/1996
WO WO 94/10365 5/1994

* cited by examiner

*Primary Examiner*—Danny Worrell
(74) *Attorney, Agent, or Firm*—Rothwell, Figg, Ernst & Manbeck, P.C.

(57) ABSTRACT

A selector actuator is provided with two controlled attraction parts (5, 6) and three non-controlled attraction parts (7, 8, 9). In the controlled attraction part (5), two magnetic coil poles having attraction sites (16*a*, 16*b*) at their top ends are arranged with a magnet in between them. In the non-controlled attraction part (7), three yokes (32*a*, 32*b*, 32*c*) having attraction sites (33*a*, 33*b*, 33*c*) at their top ends are arranged with two permanent magnets (31*a*, 31*b*) sandwiched in between them. The controlled attraction part (6) and the non-controlled attraction parts (8, 9) are similarly arranged, respectively. Each magnetic coil pole is arranged to oppose to the ends of two yokes of the same non-controlled attraction part. Hence the magnetic flux leaking from the yoke to the magnetic coil pole flows in a direction substantially perpendicular to a direction in which the attraction site of the magnetic coil pole attracts knitting members, and the magnetic flux leaking from the yoke does not affect needle selection.

4 Claims, 10 Drawing Sheets

-Prior art-

-Prior art-

-Prior art-

-Prior art-

SELECTOR ACTUATOR FOR KNITTING MEMBERS IN A KNITTING MACHINE

TECHNICAL FIELD

The present invention relates to an actuator, which is used to select knitting members such as selectors and needles that are assembled in a knitting machine.

BACKGROUND ART

A large number of needles are arranged in a needle bed of knitting machines including flat knitting machines, and a pattern knitting, such as knitting of a jacquard pattern or a design pattern, is affected by using a needle selecting means, which is provided in a carriage reciprocating over the needle bed, to select and operate needles according to knitting data. As for a selector actuator, which is to be assembled into the needle selecting means, there are two types; one wherein a selector corresponding to a needle being required for knitting is selected by energizing a magnetic coil pole to attract and retain the selector, and the other one wherein a selector corresponding to a needle being required for knitting is selected by energizing a magnetic coil pole to release attraction of the selector. The former is called an exciting hold type electromagnet, and the latter is called an exciting release type electromagnet, and the present invention covers the needle selecting means of the latter.

FIG. 7 shows a longitudinal sectional side view of a needle bed and a carriage of a flat knitting machine using exciting release type electromagnets for a selector actuator. FIG. 8 is a view of the above-mentioned selector actuator from the attraction site side. FIG. 9 is a sectional view along the line ix—ix of FIG. 8. FIG. 10 is a sectional view along the line x—x of FIG. 8.

Knitting members such as needles 102, needle jacks 103, select jacks 104 and selectors 105 are sidably loaded in a plurality of needle grooves provided in a needle bed 101. The selector 105 is kept between metal strips 107, 108 being inserted into the needle bed 101 and the select jack 104 and is inserted in the needle groove, and an elastic leg 109 of the selector 105 is compressed and a pole contact 113 of the selector 105, which is to be attracted by the selector actuator 111 is constantly pressed upwards from the selector actuator 111.

The selector actuator 111 is fixed to a bracket 122, which is provided at the lower end of a cam plate 121 of the carriage 120, by a flange 116 provided on a case 115, and attraction sites 141*a*, 141*b* of the selector actuator 111 are opposed to the pole contact 113 of the selector. When the carriage 120 reciprocates for knitting, a butt 125 of the selector 105 will be pushed into the needle groove by a selector return cam (not illustrated), which is provided on the cam plate 121 of the carriage 120 to oppose to the selector 105, against the upward press by the elastic leg 109 of the selector 105. As a result, the pole contact 113 is brought to a position wherein it is attracted and retained by the attraction sites 141*a*, 141*b* of the selector actuator 111. Under this condition, with shifting of the carriage 120, the pole contact 113 will be brought to a needle selecting part. When a contact pole of a selector corresponding to a required needle comes onto the magnetic coil poles of the first needle selecting part or the second needle selecting part, the magnetic coil poles will be energized to cancel a magnetic flux of a permanent magnet to release the pole contact 113 from the attraction sites. As a result, the butt 125 of the selector will come out above the needle bed to engage with a raising cam (not illustrated) for succeeding selectors and advance, and in turn, the selector will push up the selector jack to an intermediate position or an advanced position. Both the first and second needle selecting parts are provided with a dedicated raising cam. A degree of pushup of a selector of one raising cam differs from that of the other raising cam. The first raising cam pushes up the select jack to the intermediate position, and the second raising cam pushes up the select jack to the advanced position that is ahead of the intermediate position. With this arrangement, three-way knitting of knit, tuck and miss can be done within one course.

To make needle selection for three-way knitting, the selector actuator 111 is provided, in the case 115, with a first controlled attraction part 135 and a second controlled attraction part 136, wherein both the controlled attraction parts have magnetic coil poles in their magnetic circuits, and with three non-controlled attraction parts 137, 138, 139 having no magnetic coil poles in their magnetic circuits. The above-mentioned attraction parts have two ranks of flat attraction sites 141*a* (163*a*, 146*a*, 173*a*, 156*a*, 183*a*) and 141*b* (163*b*, 146*b*, 173*b*, 156*b*, 183*b*) on the side opposing to the pole contacts of the selectors.

The controlled attraction parts 135, 136 comprise permanent magnets 143, 153 provided at the base of the case 115, and magnetic coil poles 145*a*, 145*b*, 155*a*, 155*b* sandwiching said permanent magnets in between them and having coils 144*a*, 144*b*, 154*a*, 154*b*. The controlled attraction parts 135, 136 has attraction sites 146*a*, 146*b*, 156*a*, 156*b* (the first needle selecting part, the second needle selecting part) at the top ends of the magnetic coil poles. The non-controlled attraction parts 137, 138, 139 have permanent magnets 161, 171, 181 and side yokes 162*a*, 162*b* and center yokes 172*a*, 172*b* and side yokes 182*a*, 182*b*, said yokes sandwiching the permanent magnet in between. The top ends of these yokes are provided with attraction sites 163*a*, 163*b*, 173*a*, 173*b*, 183*a*, 183*b*. The respective attraction sites are magnetized by the permanent magnets provided for them. Of the two ranks of attraction sites, one rank is magnetized to be the north pole and the other rank is magnetized to be the south pole. Thin copper plates 190 are inserted between attraction sites of the attraction parts 135 through 139 to inhibit magnetic flux generated in the noncontrolled parts from leaking to the attraction sites of the adjacent controlled attraction parts, and in turn to allow the above-mentioned five attraction parts to form independent magnetic circuits. 140*a* and 140*b* denote protectors.

Needle selection of the conventional selector actuator 111 works as follows. The pole contact 113 of a selector is displaced against its press by a selector return cam provided on the carriage 120 to contact the attraction sites 141*a*, 141*b* of the selector actuator 111. In each of non-controlled attraction parts, magnetic flux flows from the attraction site of the yoke of the north pole side through the selector into the attraction site of the yoke of the south pole side to attract and retain the selector on the attraction sites. Under this condition, when the carriage 120 travels further and the pole contact 113 of the selector gets onto the attraction sites 146*a*, 146*b* or 156*a*, 156*b* of the first needle selection part or the second needle selection part, the magnetic coil poles will be energized to demagnetize them and release the selector from the attraction sites 146*a*, 146*b* or 156*a*, 156*b*.

However, the magnetic flux quanta leaking from the respective attraction sites of the non-controlled attraction parts 137 through 139 vary with the numbers of selectors being attracted onto the respective attraction parts 163*a*, 163*b*, 173*a*, 173*b*, 183*a*, 183*b*. The smaller are the numbers of selectors being attracted, the greater are the magnetic flux quanta leaking from the attraction sites 163*a,* 163*b,* 173*a,* 173*b,* 183*a,* 183*b.* Some of the magnetic flux flows beyond the copper plates 190 into the attraction sites 146*a,* 146*b,* 156*a,* 156*b* of the adjacent controlled attraction parts 135, 136. As a result, to release the selectors, a greater electric current, which is determined by taking the magnetic flux leakage into consideration, is required. Conversely, the larger are the numbers of the selectors attracted, the smaller are the magnetic flux leakages from the attraction sites 163*a,* 163*b,* 173*a,* 173*b,* 183*a,* 183*b.* Thus, smaller electric currents will be applied. As the difference in the number of selectors being attracted depends on designs (needle selection patterns) such as a jacquard pattern or a design pattern, the variation in the number of the selectors being attracted can not be avoided. Accordingly, if the electric currents to be passed through the magnetic coil poles 145*a,* 145*b,* 155*a,* 155*b* are constant, some selectors that must be released from the attraction sites may not be released, causing needle selection misses.

To solve the above-mentioned problem, for example, in a needle selecting means, which is disclosed in Patent Opening Hei 9-241952 (U.S. Pat. No. 5,694,792), the number of selectors being attracted by a non-controlled attraction part is determined from the needle selection pattern, and this number is used to control the electric current that is to be passed through the magnetic coil poles to release the selectors. In a needle selecting means that is disclosed in Patent Opening Sho 62-263358 (U.S. Pat. No. 4,715,198), a sensor such as a Hall element for detecting the magnetic flux quantum in a controlled attraction part is provided near the attraction sites of magnetic coil poles opposing to selectors to measure the ever-changing magnetic flux quantum, and the measured value is fed back to determine the optimal demagnetizing conditions, and in turn to release selectors irrespective of the number of selectors being attracted.

In the former needle selecting means, however, as the electric current is controlled by considering the magnetic flux leakage, an extra electric current will be needed to cancel the magnetic flux leakage. This poses a problem that the required electric current is greater. In the latter case, as sensors are provided near attraction sites of the magnetic coil poles, the entire means will become greater in size, and feedback control is needed.

DISCLOSURE OF THE INVENTION

One object of the present invention is to provide a new selector actuator for knitting members of a knitting machine that does not require feedback control, with electric currents flowing through magnetic coil poles being kept constant irrespective of variations in the number of knitting members, such as selectors, attracted onto attraction sites.

The selector actuator of the present invention for selecting knitting members of a knitting machine, for example a flat knitting machine, includes:

at least one controlled attraction part having at least two magnetic coil poles, each having an attraction site formed at the top end thereof, and arranged in a first direction with a magnet in between them; and a plurality of non-controlled attraction parts having at least two yokes, each having an attraction site formed at the top end thereof, and arranged in said first direction with a permanent magnet, for example a permanent magnet, in between them.

A direction substantially perpendicular to said first direction is defined as the second direction, and said plurality of non-controlled attraction parts are arranged in the second direction on both sides of said controlled attraction part, and said yokes have ends in said second direction.

A knitting member is released from attraction sites of the controlled attraction part by energizing the magnetic coil poles of the controlled attraction part so as to demagnetize the attraction sites of the controlled attraction part.

The selector actuator according to the invention is characterized in that at least one magnetic coil pole opposes to the ends of at least two yokes in said first direction.

Preferably, each of said non-controlled attraction parts are provided with three yokes of first, second, and third yokes, arranged in the first direction; at least two permanent magnets are arranged in between these yokes; said two permanent magnets are symmetrical in terms of magnetic pole arrangement in said first direction, with the second yoke at the center of said three yokes; one of said two magnetic coil poles is arranged to oppose to the ends of the first yoke and the second yoke; and the other one of said two magnetic coil poles is arranged to oppose to the ends of the second yoke and the third yoke.

Preferably, each of said non-controlled attraction parts has n yokes, n being greater than three, and n−1 permanent magnets arranged in between said yokes, said controlled attraction part has n−1 magnetic coil poles, and each of magnetic coil poles is arranged to oppose to the ends of at least two yokes in said first direction.

Preferably, the magnetic fields of the attraction sites of the respective magnetic coil poles upon energization are made substantially identical to each other by varying the number of coil turns from a magnetic coil pole to a magnetic coil pole or varying the electric current for energization from coil to coil.

According to the present invention, knitting members such as selectors are selected by being attracted at attraction sites of yokes of non-controlled attraction parts and by releasing or keeping the attractions at an attraction site of a controlled attraction part. Electric currents to coils of magnetic coil poles cancel a magnetic flux flowing from magnets to the attraction sites of the controlled attraction part, and release the attractions of the knitting members. A magnetic flux leaking from the yokes to the magnetic coil poles poses a problem. A degree of the magnetic flux leakage is varied according to the number of knitting members attracted by yokes. In the present invention, magnetic coil poles oppose, for example near its attraction sites, to the ends of two yokes in the first direction. Because of this arrangement, the magnetic flux leakage flows in the magnetic coil poles in a direction substantially perpendicular to a direction of attracting the knitting members at the attraction sites of the magnetic coil poles, and does not affect the attractions of the knitting members. The perpendicular direction is substantially parallel to the first direction, and the direction of magnetic flux attracting the knitting members is substantially perpendicular to the plane that is determined by the first direction and the second direction. Hence the electric currents to the coils of the magnetic coil poles may be determined independently of the number of the knitting members attracted to yokes of the non-controlled attraction parts, and in turn there is no need of monitoring the number of the knitting members attracted.

It is desirable to provide magnetic coil poles, near their attraction sites, with plates of nonmagnetic materials such as copper, aluminum and plastics as magnetic resistance. In the present invention, as the magnetic flux leakage does not affect the attraction of the knitting members at the magnetic coil poles, the magnetic resistance value may be reduced, and the attraction forces of the yokes near the magnetic coil poles may be raised. This is advantageous in accurately selecting knitting members in a fine-gauge knitting machine wherein thicknesses of knitting members are small.

However, it is not desirable to pass a magnetic flux leakage that is as high as that prevent attractions of knitting members at yokes. It is desirable to increase magnetic resistance between yokes and magnetic coil poles rather than magnetic resistance between yokes and knitting members.

BEST MODE FOR CARRYING OUT THE INVENTION

Figure 1:
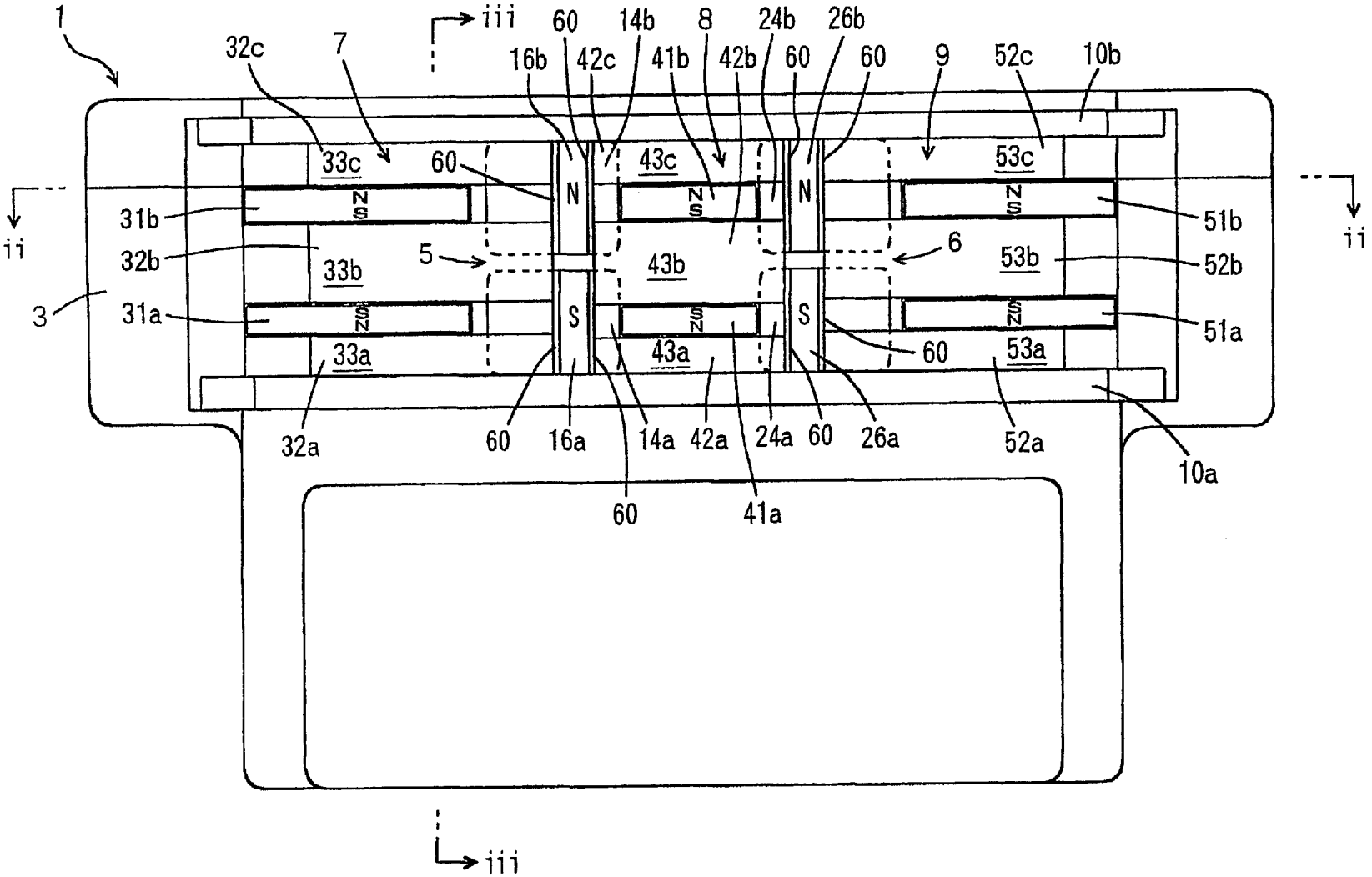
FIG. 1 is a diagram showing an embodiment of the selector actuator according to the present invention seen from the side of the attraction sites.
Figure 2:
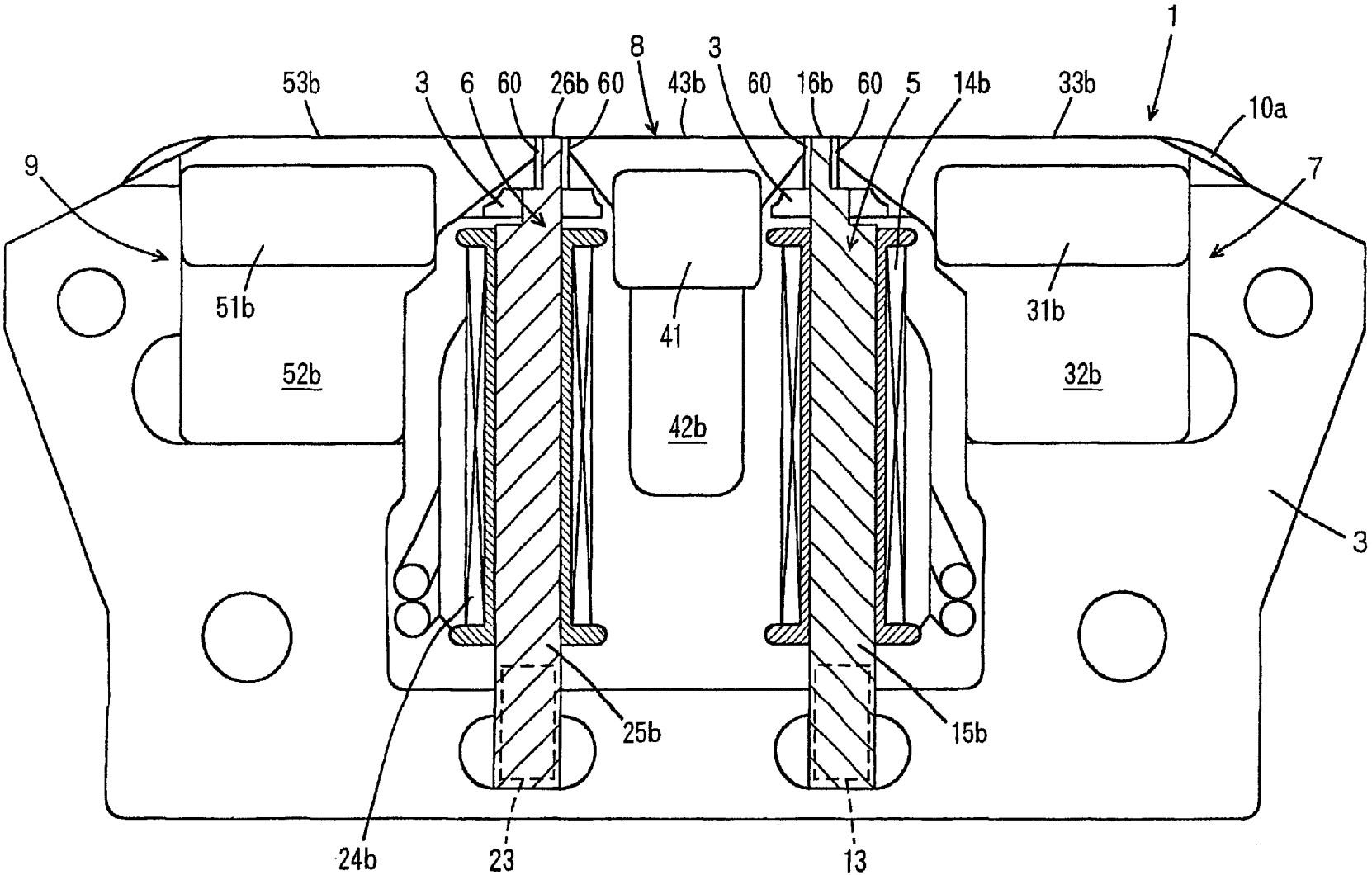
FIG. 2 is a diagram showing the selector actuator disassembled along the line ii—ii of FIG. 1.
Figure 3:
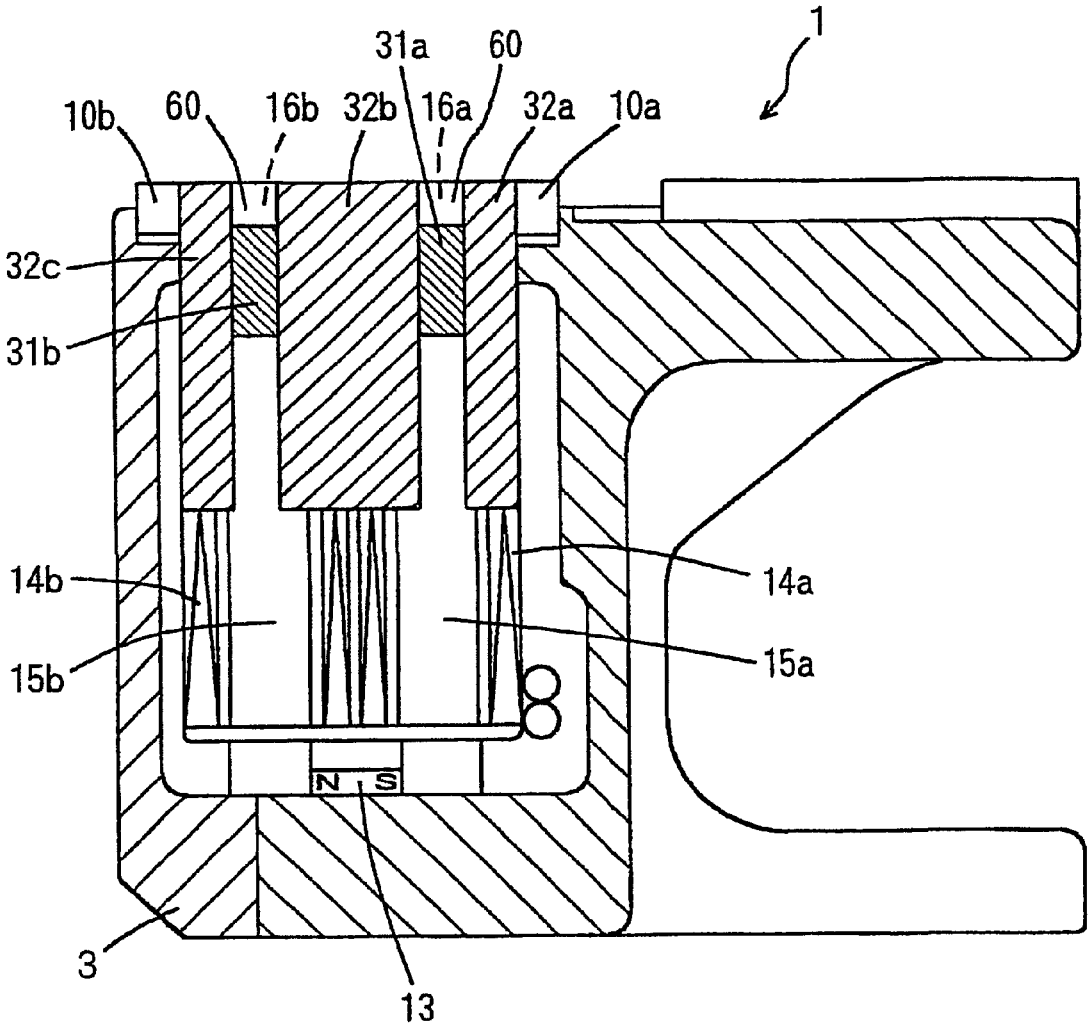
FIG. 3 is a sectional view along the line iii—iii of FIG. 1.
Figure 7:
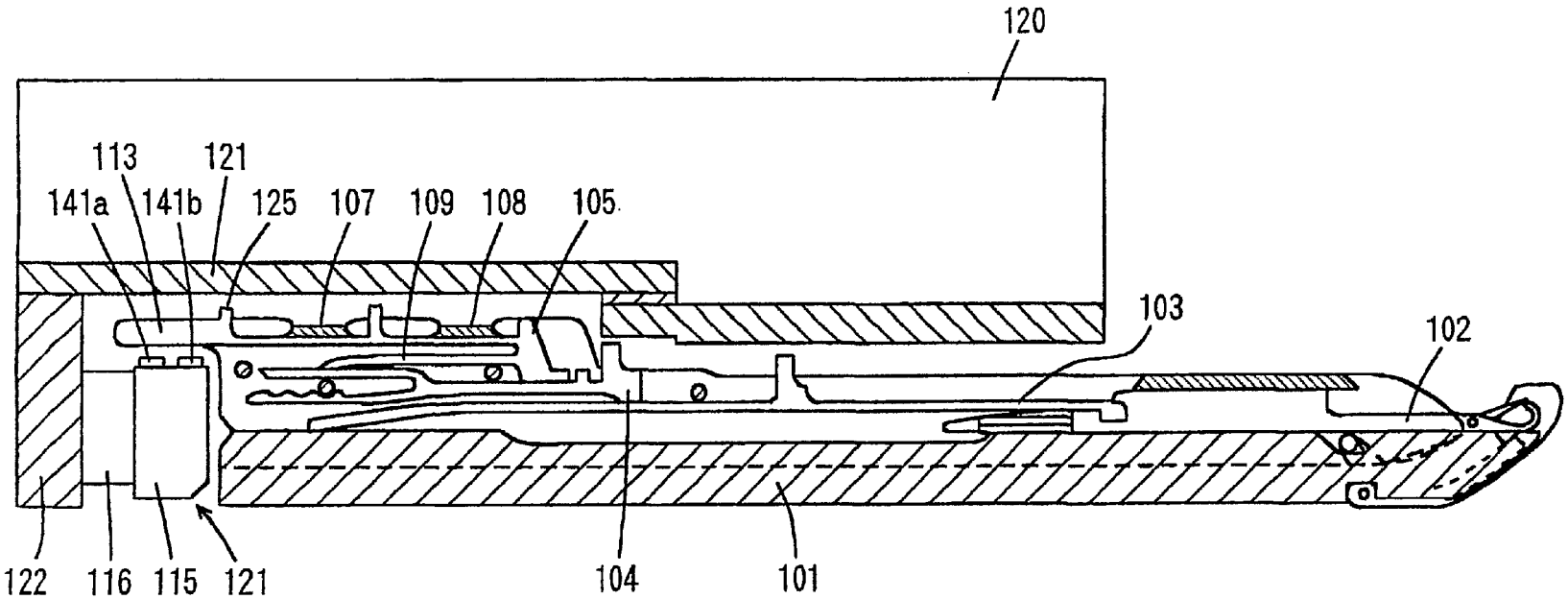
FIG. 7 is a longitudinal sectional side view of a needle bed and a carriage of a flat knitting machine having a selector actuator.
Figure 8:
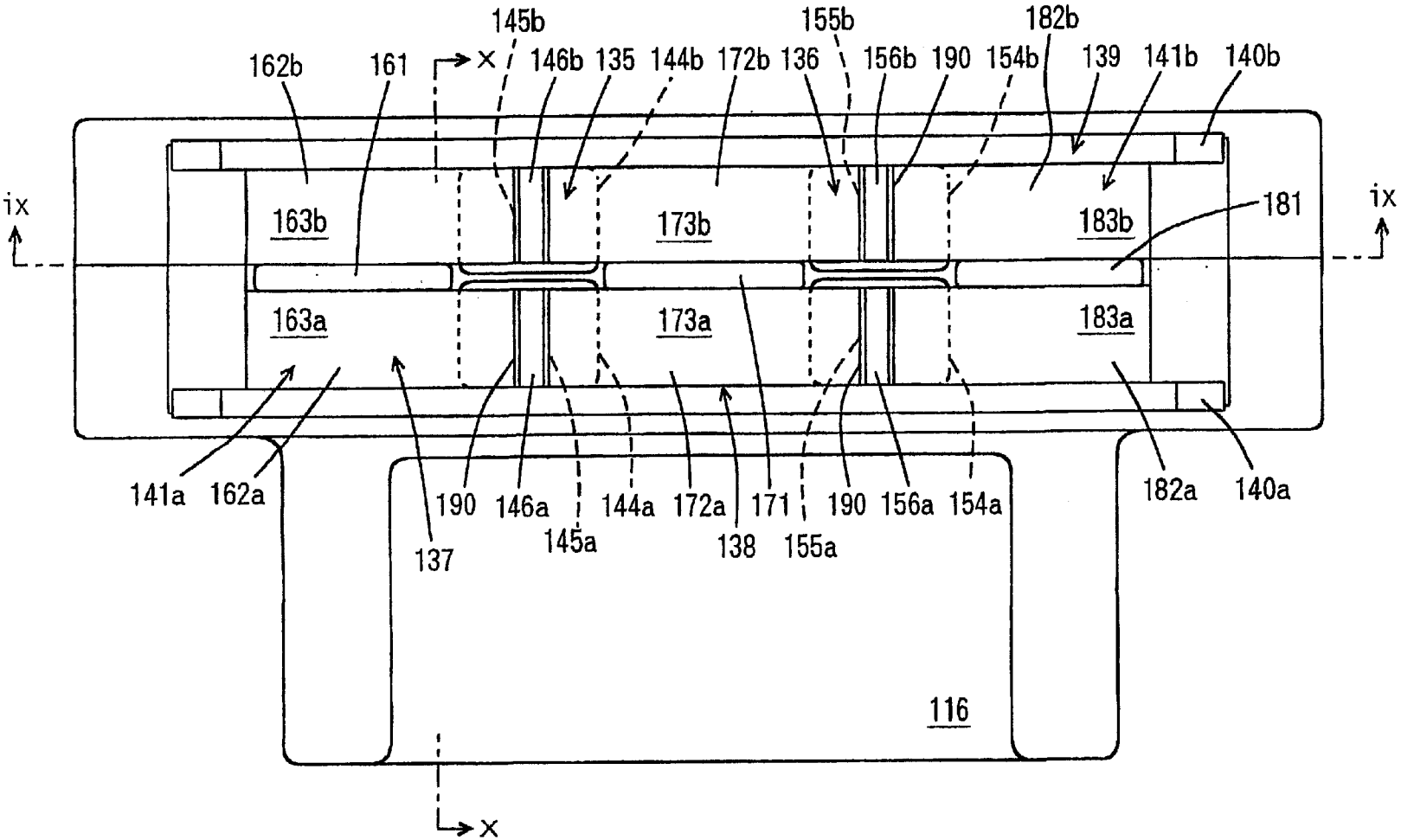
FIG. 8 is a diagram showing a conventional selector actuator seen from the side of its attraction sites.
Figure 9:
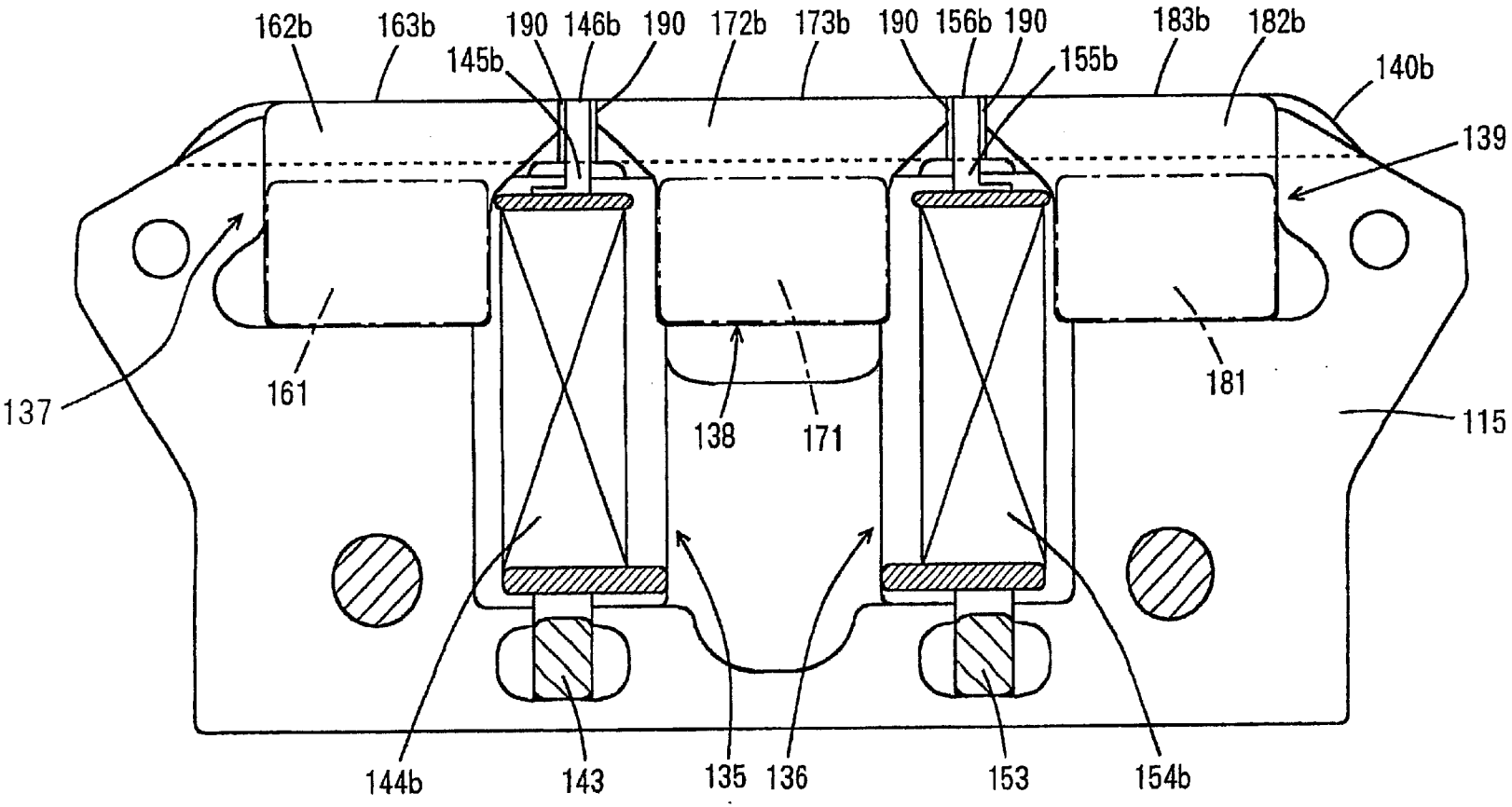
FIG. 9 is a sectional view along the line ix—ix of FIG. 8.
Figure 10:
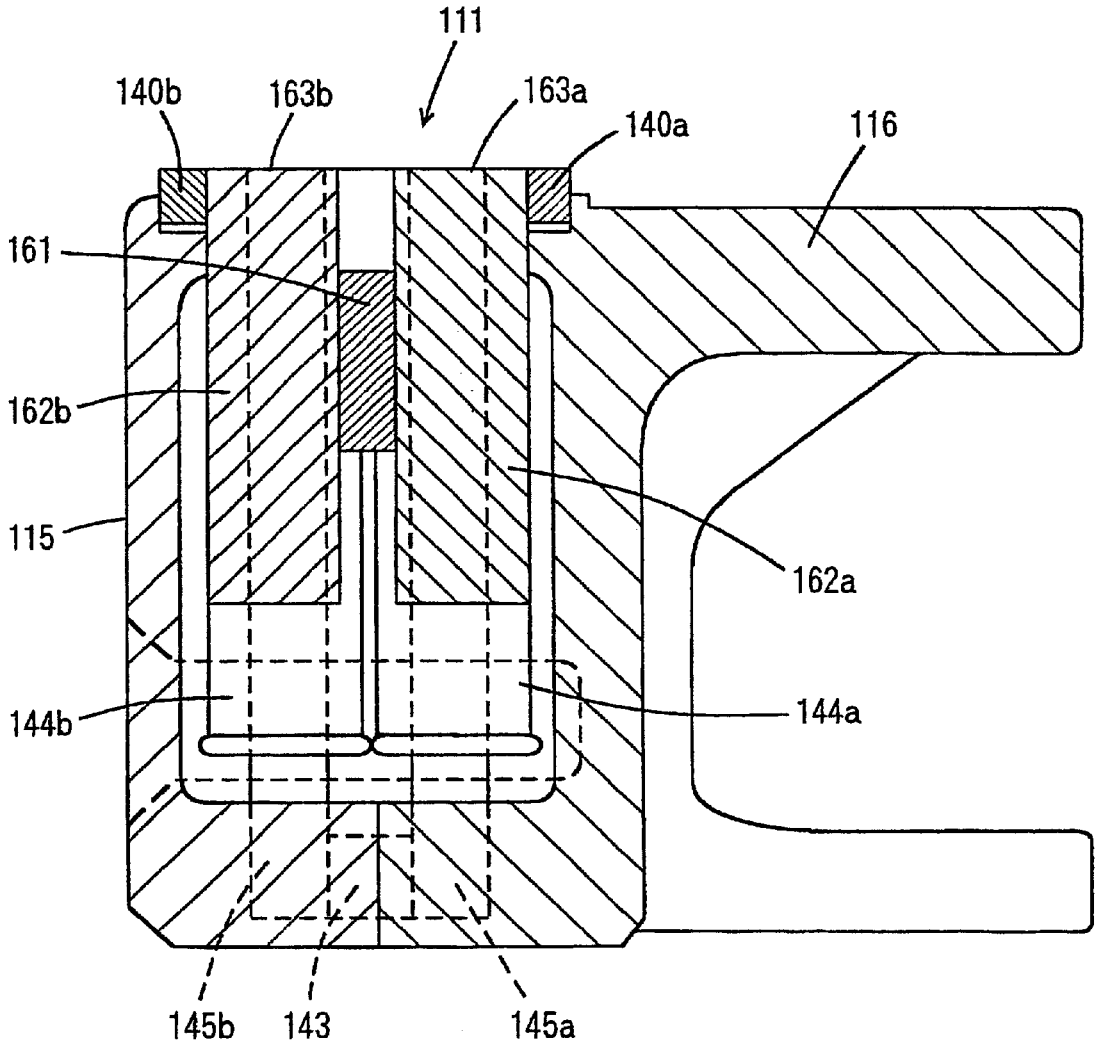
FIG. 10 is a sectional view along the line x—x of FIG. 8.

As a preferred embodiment of the present invention, an example of an application of the selector actuator for knitting members to needle selection will be described in the following with reference to the drawings. FIG. 1 through FIG. 3 show a selector actuator 1. FIG. 1 is a diagram showing the selector actuator 1 seen from the side of attraction sites that attract selectors. FIG. 2 shows the selector actuator 1 being disassembled along the line ii—ii of FIG. 1. FIG. 3 shows a section along the line iii—iii of FIG. 1. As the construction of the carriage and the needle bed of the flat knitting machine except the selector actuator are identical to those shown in FIG. 7 above, their illustrations are omitted.

In FIG. 1, the longitudinal direction of a case 3 is defined as the second direction, and the transverse direction of the case 3 is defined as the first direction. The case 3 of the selector actuator 1 is divided into two parts, an upper part and a lower part shown in FIG. 1, by the line ii—ii, and is made of aluminum. In the case 3, to make needle selections for three positions, namely, knitting, tucking and missing, two controlled attraction parts (a first controlled attraction part 5 and a second controlled attraction part 6) and three non-controlled attraction parts 7, 8, 9 having side yokes 32*a*, 32*b*, 32*c*, 52*a*, 52*b*, 52*c* and center yokes 42*a*, 42*b*, 42*c* are stored.

The controlled attraction parts 5, 6 comprise permanent magnets 13, 23 provided in the base of the case 3, and magnetic coil poles 15*a*, 15*b*, 25*a*, 25*b* sandwiching the permanent magnets 13, 23 and having coils 14*a*, 14*b*, 24*a*, 24*b*. Attraction sites 16*a*, 16*b* (the first needle selecting part) and attraction sites 26*a*, 26*b* (the second needle selecting part) are formed at the top ends of these magnetic coil poles 15*a*, 15*b*, 25*a*, 25*b*.

It should be noted that, as shown in FIG. 1, the non-controlled attraction part 7 of the selector actuator 1 of the present embodiment comprises three ranks of side yokes 32*a*, 32*b*, 32*c* and permanent magnets 31*a*, 31*b* being sandwiched in between these side yokes. These permanent magnets 31*a*, 31*b* magnetize the attraction sites 33*a*, 33*b*, 33*c* being formed at the top ends of the respective yokes. Similarly, the non-controlled attraction part 8 comprises center yokes 42*a*, 42*b*, 42*c* and permanent magnets 41*a*, 41*b*. The non-controlled attraction part 9 comprises side yokes 52*a*, 52*b*, 52*c* and permanent magnets 51*a*, 51*b*. The attraction sites 43*a*, 43*b*, 43*c* and 53*a*, 53*b*, 53*c* being formed at the top ends of the respective yokes are magnetized.

The controlled attraction parts and the non-controlled attraction parts are arranged in such a way that, of the yokes being arranged in three ranks of the non-controlled attraction parts 7 through 9, the side yoke 32*b*, the center yoke 42*b* and the side yoke 52*b* being located at the center are close to both a south and a north poles of the magnetic coil poles of the controlled attraction parts. In the non-controlled attraction parts, a south pole and a south pole or a north pole and a north pole of the permanent magnets are arranged to oppose to each other and sandwich yokes in between them so that the above-mentioned yokes 32*b*, 42*b*, 52*b* are magnetized. Copper plates 60 being thinner than the selector are inserted as magnetic resistance between the attraction sites of the controlled attraction parts 5, 6 and the attraction sites of the non-controlled attraction parts 7 through 9. Accordingly, magnetic flux generated at the non-controlled attraction parts are prohibited from leaking from the attraction sites 33*a* through 33*c*, 43*a* through 43*c*, 53*a* through 53*c* to the attraction sites 16*a*, 16*b*, 26*a*, 26*b* of adjacent controlled attraction parts. Thus, the above-mentioned five attraction parts 5 through 9 produce independent magnetic circuits.

The above-mentioned copper plates 60 have a thickness that allows the selectors being kept attracted onto the attraction sites to be brought to the attraction sites of the following controlled attraction part or the non-controlled attraction parts. Now, if we assume that the magnetic resistance between the non-controlled attraction part and the controlled attraction part is Ra and the magnetic resistance between the non-controlled attraction part and the selector being attracted by the non-controlled attraction part is Rb, the copper plates 60 installed satisfy a condition Ra>Rb. As a result, the magnetic flux being generated at the non-controlled attraction part is prevented by the copper plates 60 from flowing to the magnetic coil poles, and the selectors may be kept attracted. As for the magnetic resistance, nonmagnetic materials or a gap may be used in place of the copper plates 60. As the side yoke 32*b*, the center yoke 42*b* and the side yoke 52*b* being located at the center are arranged to be close to both the south and north poles of the magnetic coil poles of the controlled attraction parts, the leaking magnetic flux from the non-controlled attraction parts will positively flow from one yoke through the magnetic coil pole to the other opposing yoke. As this leaking magnetic flux flows in a direction that is perpendicular to the direction of the magnetic flux that is generated in the magnetic coil pole when a selector is to be released, the leaking magnetic flux will not affect the release of a selector with energizing.

The magnetic coil poles 15*a*, 15*b* are made of a magnetic material such as silicon steel, and when the attraction sites 16*a*, 16*b* are considered as the center, the magnetic coil poles 15*a*, 15*b* are non symmetrically arranged near the yokes 33*a*, 33*b*, 33*c*. The magnetic coil poles 25*a*, 25*b* are also arranged in a similar manner. This has a role of shortening the length of the yokes 42*a*, 42*b*, 42*c* in the second direction.

For example, when no selector is attracted to the side yokes 32*a* through 32*c* of the non-controlled attraction part 7, of the magnetic flux being generated by the permanent magnets 31*a*, 31*b* of the non-controlled attraction part 7, the magnetic flux leakage flowing to the magnetic coil poles flows from the side yokes 32*a*, 32*c*, crosses the magnetic coil poles 15*a*, 15*b* being adjacent to the side yokes 32*a*, 32*c*, and flows to the opposing side yoke 32*b* at the center. Hence the magnetic flux leakage doesn't affect the attraction at the attraction sites of the magnetic coil poles. When the selector is attracted on the attraction sites of the side yokes 32*a* through 32*c*, the magnetic flux being generated by the permanent magnets 31*a*, 31*b* will work on the selector.

However, as the three ranks of side yokes 32*a*, 32*b*, 32*c* are magnetized, and one magnetic coil pole 15*a* of the controlled attraction part 5 is magnetized to the south pole and the other magnetic coil pole 15*b* of the controlled attraction part 5 is magnetized to the north pole, the distribution of magnetic field around the magnetic coil pole 15*a* differs from that around the magnetic coil pole 15*b*. Accordingly, if both the magnetic coil poles 15*a*, 15*b* have the same number of coil turns and they are controlled by the same electric current, the magnetic fields at the attraction sites 16*a*, 16*b* can not be demagnetized equally, and the attraction sites 16*a*, 16*b* will not be able to release the selector with energizing. Hence to ensure equal demagnetization at the attraction sites 16*b*, 16*a*, the numbers of turns of the respective coils and/or the electric currents to the respective coils are set at different values. This may be responded by changing the materials and/or configurations of the magnetic coil poles as well.

In the case of the present embodiment, the magnetic coil pole 15*b* having the same pole (north pole) with the side yoke 32*c* has a weaker magnetic field than that of the magnetic coil pole 15*a* of which magnetic pole differs from that of the side yoke 32*a*. Hence the number of turns of the coil is reduced to make the magnetic field at the attraction site 16*b* after demagnetization equal to that at the attraction site 16*a*. Constructions similar to those of the above-mentioned non-controlled attraction part 7 and the controlled attraction part 5 apply to the other non-controlled attraction parts 8, 9 and the controlled attraction part 6. 10*a*, 10*b* in the drawings denote protectors.

Needle selection by the selector actuator 1, which is constructed as described above, is effected as follows. It is assumed that the carriage travels leftwards. First, a selector will be displaced against the elastic press by a selector return cam being provided on the carriage, and the selector will contact the attraction sites of the selector actuator 1. At the non-controlled attraction part 7, the selector is kept attracting onto the attraction sites by the magnetic flux of the permanent magnet 31*a*, which flows from the attraction site 33*a* of the side yoke 32*a* (north pole) through the selector to the attraction site 33*b* of the side yoke 32*b*, and by the magnetic flux of the permanent magnet 31*b*, which flows from the attraction site 33*c* of the side yoke 32*c* through the selector to the attraction site 33*b* of the side yoke 32*b*. Under this condition, the carriage will travel, and when the selector comes onto the attraction sites 16*a*, 16*b* of the controlled attraction part 5 (the first needle selecting part), the magnetic coil poles 15*a*, 15*b* will be energized to demagnetize the magnetic field of the permanent magnet 13 and release the selector from the attraction sites 16*a*, 16*b*.

As side yokes and the magnetic coil poles are arranged to be close to each other, of the magnetic flux being generated by the permanent magnets, the magnetic flux leakage heading to the magnetic coil poles will cross the magnetic coil poles and will flow to the opposing side yokes at the center. Thus, even if the number of selectors attracted onto the attraction sites of the non-controlled attraction part varies, effects of the selectors at the magnetic coil poles will be cancelled and the routes will become independent. As a result, even when the number of selectors to be attracted is small, the magnetic coil poles will not be affected by the magnetic flux leakage in contrast to the prior art, and a large electric current will not be required, and to turn on a constant electric current to the coils will be able to release the selectors.

What described above is similarly applicable to the case of releasing selectors, which has been attracted by the following non-controlled attraction part 8, at the attraction sites 26*a*, 26*b* of the second needle selecting part. The needle selection by the selector actuator 1 similarly works when the direction of travel of the carriage is reversed and the carriage travels rightward.

[Modifications]

Figure 4:
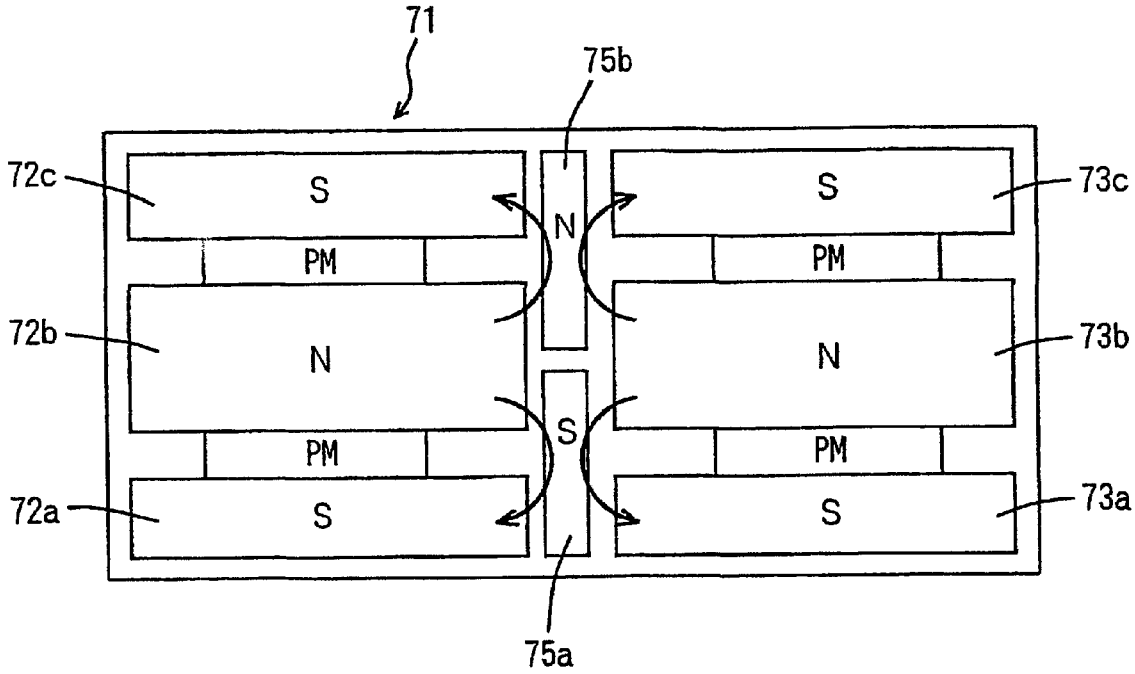
FIG. 4 is a diagram of a modification of the selector actuator according to the present invention, showing the arrangement of a controlled attraction part and non-controlled attraction parts.
Figure 5:
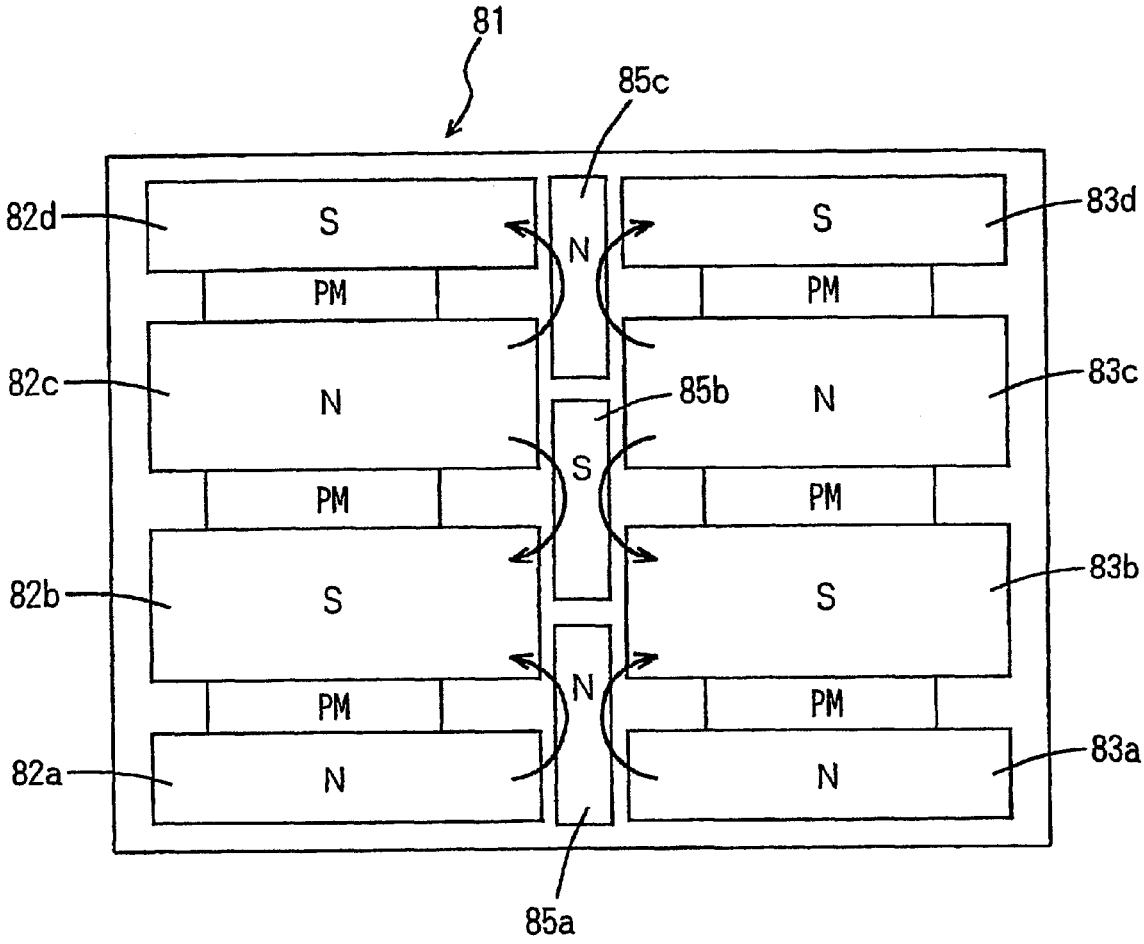
FIG. 5 is a diagram of another modification of the selector actuator according to the present invention, showing the arrangement of a controlled attraction part and non-controlled attraction parts.
Figure 6:
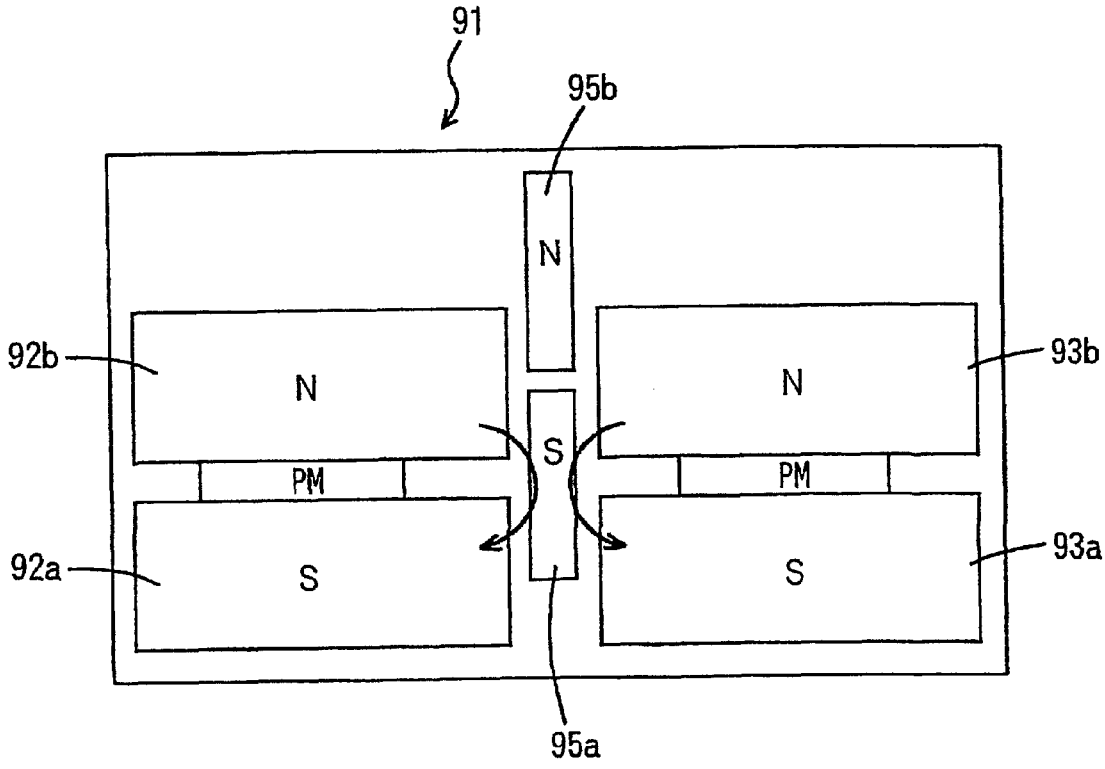
FIG. 6 is a diagram of another modification of the selector actuator according to the present invention, showing the arrangement of a controlled attraction part and non-controlled attraction parts.

FIG. 4 through FIG. 6 show modifications of the selector actuator according to the present invention. They show examples wherein only one controlled attraction part is provided to select knitting members. PM in the diagrams denotes permanent magnets, and the magnetic resistance to be provided between yokes and magnetic coil poles are gaps in these constructions.

FIG. 4 is similar to the above-mentioned embodiment, and of the yokes 72*a*, 72*b*, 72*c*, 73*a*, 73*b*, 73*c* arranged in three ranks in the respective noncontrolled attraction parts, the yokes 72*b*, 73*b* at the center are arranged to be close to both the magnetic coil poles 75*a*, 75*b* of the controlled attraction part. The arrows in FIG. 4 through FIG. 6 indicate magnetic flux from yokes via magnetic coil poles.

FIG. 5 shows a selector actuator 81 wherein yokes are arranged in four ranks (82*a*, 82*b*, 82*c*, 82*d*, 83*a*, 83*b*, 83*c*, 83*d*) and magnetic coil poles are arranged in three ranks (85*a*, 85*b*, 85*c*). It is possible to increase the number of yokes and the number of magnetic coil poles further more. In any case, the magnetic flux leakage from a yoke is guided through a bypass provided by a magnetic coil pole to flow into the opposing yoke. In this way, magnetic flux is prevented from leaking to attraction sites of the magnetic coil poles. When it is necessary to increase the attraction force of the selector actuator, this can be done by increasing the number of serial yokes. For example, the finer is the gauge of the knitting machine, the thinner is the thickness of the selector. If a given thickness of the selector is not sufficient to get an adequate attraction force, the above-mentioned arrangement allows an increase in the attraction area in the longitudinal direction of the selector.

FIG. 6 shows an example wherein a pair of yokes (92*a*, 92*b* or 93*a*, 93*b*) or magnetic coil poles (95*a*, 95*b*) are provided in each attraction part. FIG. 6 shows a selector actuator 91 wherein the yokes and the magnetic coil poles are staggered from each other so that both the pair of yokes 92*b*, 93*b* and the pair of yokes 92*a*, 93*a* are close to the magnetic coil pole 95*a* in a controlled attraction part.

As described so far, in the selector actuator according to the present invention, of the magnetic flux being generated by permanent magnets of a noncontrolled attraction part, the magnetic flux leakage heading to magnetic coil poles will cross magnetic coil poles being provided close to the respective opposing yokes. Thus, even when the number of selectors to be attracted onto the attraction sites of a non-controlled attraction part is small, effects of the magnetic flux leakage, which affected the selection of knitting members in the prior art, are eliminated. Hence, in contrast to the prior art, it is not necessary to control the electric current by considering the magnetic flux leakage, which varies according to the number of knitting members to be attracted. Moreover, it is not necessary to provide sensors to give feedback control. The electric current to be passed through a magnetic coil pole can be made constant at any time.

Embodiments of the present invention have been described so far. The present invention, however, is not limited in any way by the above-mentioned embodiments.

What is claimed is:

1. A selector actuator for knitting members of a knitting machine comprising:

at least one controlled attraction part having at least two magnetic coil poles, respectively provided with an attraction site at the top end thereof, and arranged in a first direction with a magnet in between them; and a plurality of non-controlled attraction parts having at least two yokes, respectively provided with an attraction site at the top end thereof, and arranged in said first direction with a magnet in between them, wherein said plurality of non-controlled attraction parts are arranged on both sides of said controlled attraction part in the second direction substantially perpendicular to the first direction, and said yokes have ends along with said second direction, and wherein a knitting member is released from the attraction sites of the controlled attraction part by energizing the magnetic coil poles of the controlled attraction part so as to demagnetize the attraction sites of the controlled attraction part, being characterized in that at least one magnetic coil pole of said controlled attraction part opposes to the ends of at least two yokes in said first direction.

2. A selector actuator for knitting members of a knitting machine of claim 1 being characterized in that each of said non-controlled attraction parts is provided with three yokes of first, second, and third yokes, arranged in the first direction, that at least two permanent magnets are arranged in between said three yokes, that said two permanent magnets are symmetrical in terms of magnetic pole arrangement in said first direction, with the second yoke being at the center of said three yokes, that one of said two magnetic coil poles is arranged to oppose to the ends of the first yoke and the second yoke, and that the other one of said two magnetic coil poles is arranged to oppose to the ends of the second yoke and the third yoke.

3. A selector actuator for knitting members of a knitting machine of claim 2 being characterized in that each of said non-controlled attraction parts has n yokes and n−1 permanent magnets being arranged in between said yokes, wherein n is grater than three, that said controlled attraction part has n−1 magnetic coil poles, and that each of magnetic coil poles is arranged to oppose to the ends of at least two yokes in said first direction.

4. A selector actuator for knitting members of a knitting machine of claim 1 being characterized in that magnetic fields of the attraction sites of the respective magnetic coil poles when energized are made substantially identical to each other with the number of coil turns or the electric currents for the energization being varied from magnetic coil poles to magnetic coil poles.

* * * * *